US006758905B2

(12) United States Patent
Suzuki et al.

(10) Patent No.: US 6,758,905 B2
(45) Date of Patent: Jul. 6, 2004

(54) FLUORESCENT LAYER FORMING APPARATUS

(75) Inventors: Kazuo Suzuki, Kawasaki (JP); Yoshimi Shirakawa, Kawasaki (JP); Tatsutoshi Kanae, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/419,762

(22) Filed: Apr. 22, 2003

(65) Prior Publication Data

US 2003/0203099 A1 Oct. 30, 2003

(30) Foreign Application Priority Data

Apr. 24, 2002 (JP) ..... 2002-122963
Aug. 13, 2002 (JP) ..... 2002-236057

(51) Int. Cl.[7] ..... B05C 5/00
(52) U.S. Cl. ..... 118/300; 239/390; 239/594
(58) Field of Search ..... 118/300, 301; 239/390, 594, 104, 288, 288.3

(56) References Cited

U.S. PATENT DOCUMENTS 2,116,863 A * 5/1938 Dinley ..... 239/594
5,820,025 A * 10/1998 Troudt ..... 239/119
6,075,319 A * 6/2000 Kanda et al. ..... 313/584
2001/0032887 A1 * 10/2001 Everett ..... 239/594
2002/0009536 A1 * 1/2002 Iguchi et al. ..... 118/669

FOREIGN PATENT DOCUMENTS

JP 11-204032 7/1999

* cited by examiner

*Primary Examiner*—Richard Crispino
*Assistant Examiner*—Yewebdar Tadesse
(74) *Attorney, Agent, or Firm*—Westerman, Hattori, Daniels & Adrian, LLP

(57) ABSTRACT

The present invention provides a fluorescent layer forming apparatus for applying a fluorescent material paste into a recess defined between barrier ribs formed on a substrate for formation of a fluorescent layer in a plasma display panel production process. The apparatus comprises: a nozzle for ejecting the fluorescent material paste; and a plurality of fine attachments provided at one end of the nozzle with distal end portions thereof being arranged in convergent relation. The fluorescent material paste is ejected along the plurality of fine attachments thereby to be applied into the recess without formation of a clot. Thus, the fluorescent layer can accurately be formed in the intended recess between the barrier ribs without adhesion of the fluorescent material paste onto the top edges of the barrier ribs.

10 Claims, 14 Drawing Sheets

FIG. 5 (A)

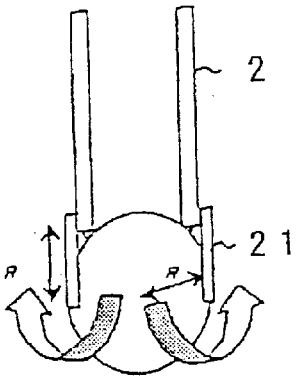

FIG. 5 (B)

| γ (N/m) | ρ (kg/m³) | FACTOR |
|---|---|---|
| 7.0E-02 | 1.0E+03 | 1.75E-02 |
| 1.0E-01 | 1.5E+03 | 1.72E-02 |
| 7.0E-02 | 1.5E+03 | 1.53E-02 |
| 5.0E-02 | 1.5E+03 | 1.37E-02 |
| 2.0E-02 | 1.5E+03 | 1.01E-02 |

FIG. 5 (C) OUTER DIAMETER OF ORDINARY NOZZLE

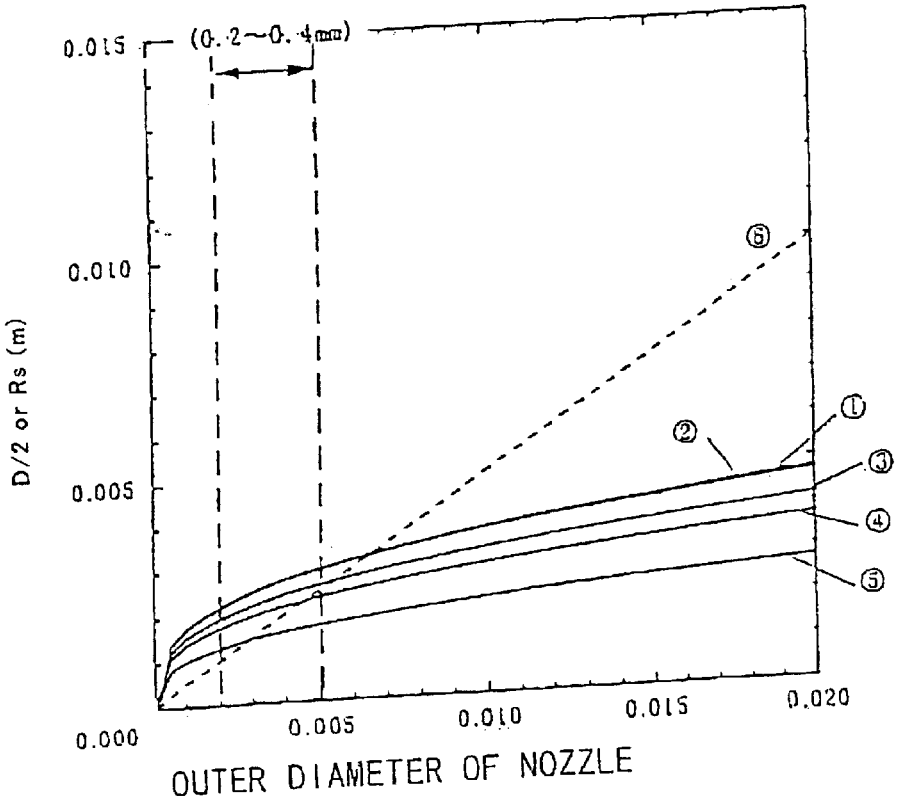

① $\gamma = 70 \times 10^{-3}$ N/m, $\rho = 1.0 \times 10^{3}$ kg/m³ ⇒ $y = 1.75 \times 10^{-2} D^{1/3}$ ② $\gamma = 100 \times 10^{-3}$ N/m, $\rho = 1.5 \times 10^{3}$ kg/m³ ⇒ $y = 1.72 \times 10^{-2} D^{1/3}$ ③ $\gamma = 70 \times 10^{-3}$ N/m, $\rho = 1.5 \times 10^{3}$ kg/m³ ⇒ $y = 1.53 \times 10^{-2} D^{1/3}$ ④ $\gamma = 50 \times 10^{-3}$ N/m, $\rho = 1.5 \times 10^{3}$ kg/m³ ⇒ $y = 1.37 \times 10^{-2} D^{1/3}$ ⑤ $\gamma = 20 \times 10^{-3}$ N/m, $\rho = 1.5 \times 10^{3}$ kg/m³ ⇒ $y = 1.01 \times 10^{-2} D^{1/3}$ ⑥ $y = D / 2$

FLUORESCENT LAYER FORMING APPARATUS

CROSS-REFERENCE TO RELATED APPLICATION

This application is related to Japanese Patent Application Nos. 2002-122963 filed on Apr. 24, 2002 and 2002-236057 filed on Aug. 13, 2002, whose priorities are claimed under 35 USC §119, the disclosure of which is incorporated by reference in its entirety.

BACKGROUND OF THE INVENTION

1. Field of the Invention

The present invention relates to an apparatus for forming a fluorescent layer in a plasma display panel and, more particularly, to a fluorescent layer forming apparatus including an improved nozzle.

2. Description of the Related Art

A conventional fluorescent layer forming apparatus disclosed in Japanese Unexamined Patent Publication No. H11-204032 (1999) will be described with reference to FIGS. 13, 14(A) and 14(B). The conventional fluorescent layer forming apparatus includes a dispenser 201 which has a plurality of ejection ports generally linearly arranged at predetermined intervals. In a fluorescent layer forming process employing the conventional fluorescent layer forming apparatus, as shown in FIG. 13, a fluorescent material paste 207 prepared by dispersing fluorescent particles in a liquid medium is ejected from the dispenser 201 through a mask 226 into linear recesses defined between plural barrier ribs 224 arranged parallel to each other on a rear substrate 220, and heat-treated for formation of fluorescent layers 225. As shown in FIGS. 14(A) and 14(B), the dispenser 201 includes fine rod-shaped guides 221 which respectively project from the ejection ports generally centrally of the ejection ports. The fluorescent material paste 207 is ejected along the guides 221, while the dispenser 201 is moved relative to the substrate 220. Thus, the fluorescent layers 225 are formed in the linear recesses between the barrier ribs 224.

In the conventional fluorescent layer forming apparatus, the fluorescent material paste which has a high viscosity and a low surface tension unlike water is attracted to the guides 221 and falls vertically downward. Where the guides 221 are each composed of a hair or a polyamide filament, the fluorescent material paste can be ejected with the guides 221 kept in contact with the bottoms of the recesses. Thus, the conventional fluorescent layer forming apparatus can assuredly apply the fluorescent material paste into the recesses.

In the conventional fluorescent layer forming apparatus having the aforesaid construction, the fluorescent material paste is simply ejected along the guides from the ejection ports. At this time, the fluorescent material paste is liable to clot around the guides to form relatively large clots, depending on the viscosity of the fluorescent material paste. As a result, the fluorescent material paste is likely to adhere onto top edges of the barrier ribs or to enter recesses adjacent to the intended recesses (thereby to be mixed in different color fluorescent material pastes applied in the adjacent recesses). Thus, the conventional fluorescent layer forming apparatus fails to accurately form the fluorescent layers.

SUMMARY OF THE INVENTION

To overcome the aforesaid drawback, the present invention is directed to a fluorescent layer forming apparatus which is capable of accurately forming a fluorescent layer without formation of a relatively large clot of a fluorescent material paste.

In accordance with one aspect of the present invention, there is provided a fluorescent layer forming apparatus for applying a fluorescent material paste into a recess defined between barrier ribs formed on a substrate for formation of a fluorescent layer in a plasma display panel production process, the apparatus comprising: a nozzle for ejecting the fluorescent material paste; and a plurality of fine attachments provided at one end of the nozzle with distal end portions thereof being arranged in convergent relation, whereby the fluorescent material paste is ejected along the plurality of fine attachments so as to be applied onto a predetermined position in the recess for the formation of the fluorescent layer. According to this inventive aspect, proximal ends of the fine attachments are fixed to the nozzle, and the distal ends of the fine attachments are arranged in convergent relation. When the fluorescent material paste is supplied into the nozzle, the front of the fluorescent material paste moves along the plurality of fine attachments arranged in convergent relation. Therefore, the fluorescent material paste is convergently retained between the fine attachments and ejected from the nozzle without formation of a clot. Hence, the fluorescent layer can accurately be formed in the intended recess defined between the barrier ribs without adhesion thereof onto the top edges of the barrier ribs.

In accordance with the present invention, the fine attachments are adapted to control the eject line of the fluorescent material paste for guiding the fluorescent material paste to a predetermined position in the recess.

Specific example of the material for the fine attachments includes stainless.

The inventive fluorescent layer forming apparatus may be adapted to eject the fluorescent material paste with the distal ends of the fine attachments kept in contact with the bottom of the recess defined between the barrier ribs. In this case, the nozzle is scanned for the application of the fluorescent material paste, while the distal ends of the fine attachments fixed to the nozzle are kept in contact with the bottom of the recess. Therefore, the fluorescent material paste is guided along the fine attachments into the recess between the barrier ribs. Thus, the fluorescent layer can more accurately be formed in the intended recess between the barrier ribs.

In the inventive fluorescent layer forming apparatus, the fine attachments may each be composed of a material having a wetting contact angle of not greater than 60 degrees with respect to the fluorescent material paste. In this case, the fluorescent material paste supplied to the nozzle smoothly moves along the fine attachments composed of the material having a wetting contact angle of not greater than 60 degrees with respect to the fluorescent material paste without stagnation, and is ejected at a predetermined ejection rate from the nozzle without formation of a clot. As a result, the fluorescent layer thus formed has a uniform thickness.

In the inventive fluorescent layer forming apparatus, the fluorescent material paste may have a viscosity of 5 Pa·s to 50 Pa·s at a sheer rate of 4 $s^{-1}$. In accordance with the present invention, the term "sheer rate" refers to a velocity gradient of a flux of the fluorescent material paste. More specifically, it refers to a velocity gradient determined by a flux of the fluorescent material past being ejected from the nozzle and a flux of the fluorescent material paste retained in a retaining portion of the nozzle at a position from the center line of the nozzle a predetermined distance.

An appropriate value of the viscosity of the fluorescent material paste can be determined in accordance with Hagen- Poiseuille's formula using the inner diameter of the nozzle, the amount of the fluorescent material paste to be ejected, the pressure under which the fluorescent material paste is to be ejected and the like as parameters. In this case, the fluorescent material paste having a viscosity of 5 Pa·s to 50 Pa·s at a sheer rate of 4 $s^{-1}$ is supplied to the nozzle and, therefore, smoothly moves along the fine attachments without stagnation and is ejected at a predetermined ejection rate from the nozzle without formation of a clot. As a result, the fluorescent layer thus formed has a uniform thickness.

In accordance with another aspect of the present invention, there is provided a fluorescent layer forming apparatus for applying a fluorescent material paste into a recess defined between barrier ribs formed on a substrate for formation of a fluorescent layer in a plasma display panel production process, the apparatus comprising: a nozzle for ejecting the fluorescent material paste; and a plurality of fine attachments provided at one end of the nozzle as projecting from the nozzle; wherein portions of the fine attachments projecting from the nozzle each have a length not smaller than the radius of the nozzle. According to this inventive aspect, the portions of the fine attachments projecting from the nozzle each have a length not smaller than the radius of the nozzle, so that the fluorescent material paste can smoothly and accurately be applied dropwise into the recess without deflection thereof around the outer periphery of the fine attachments. Therefore, the fluorescent material paste can smoothly be applied dropwise into the recess continuously for a long period of time.

In accordance with further another aspect of the present invention, there is provided a fluorescent layer forming apparatus for applying a fluorescent material paste into a recess defined between barrier ribs formed on a substrate for formation of a fluorescent layer in a plasma display panel production process, the apparatus comprising: a nozzle having an outlet for ejecting the fluorescent material paste; and a plurality of fine attachments provided at one end of the nozzle, the fine attachments defining a retention portion having a greater cross sectional area than the outlet of the nozzle and an ejection port having a smaller cross sectional area than the retention portion. According to this inventive aspect, the retention portion having a greater cross sectional area than the outlet of the nozzle and the ejection port having a smaller cross sectional area than the retention portion are defined by the fine attachments fixed to the end of the nozzle. Therefore, the fluorescent material paste can accurately be applied into the recess. Since the fluorescent material paste is once retained in the retention portion and then ejected, the fluorescent material paste can smoothly be supplied even if the ejection rate of the fluorescent material paste is changed.

The inventive fluorescent layer forming apparatus may further comprise a filter provided above a fluorescent material paste supply port of the nozzle, wherein proximal ends of the fine attachments are fixed to the filter. In this case, the filter provided above the fluorescent material paste supply port of the nozzle has a predetermined mesh size, so that particles greater in size than the predetermined mesh size can be filtered out for prevention of clogging of the nozzle before the fluorescent material paste is supplied into the nozzle. Thus, stable formation of the fluorescent layer can be ensured for a long period of time.

BRIEF DESCRIPTION OF THE DRAWINGS

FIG. 5(A) is a detailed diagram illustrating a nozzle of a fluorescent layer forming apparatus according to a third embodiment of the present invention;

FIG. 5(B) is a table showing a factor determined by the surface tension and density of a fluorescent material paste in accordance with the third embodiment;

FIG. 5(C) is a graph illustrating a relationship between the outer diameter of the nozzle and the length of fine attachments in accordance with the third embodiment;

DESCRIPTION OF THE PREFERRED EMBODIMENTS

First Embodiment

Figure 1:
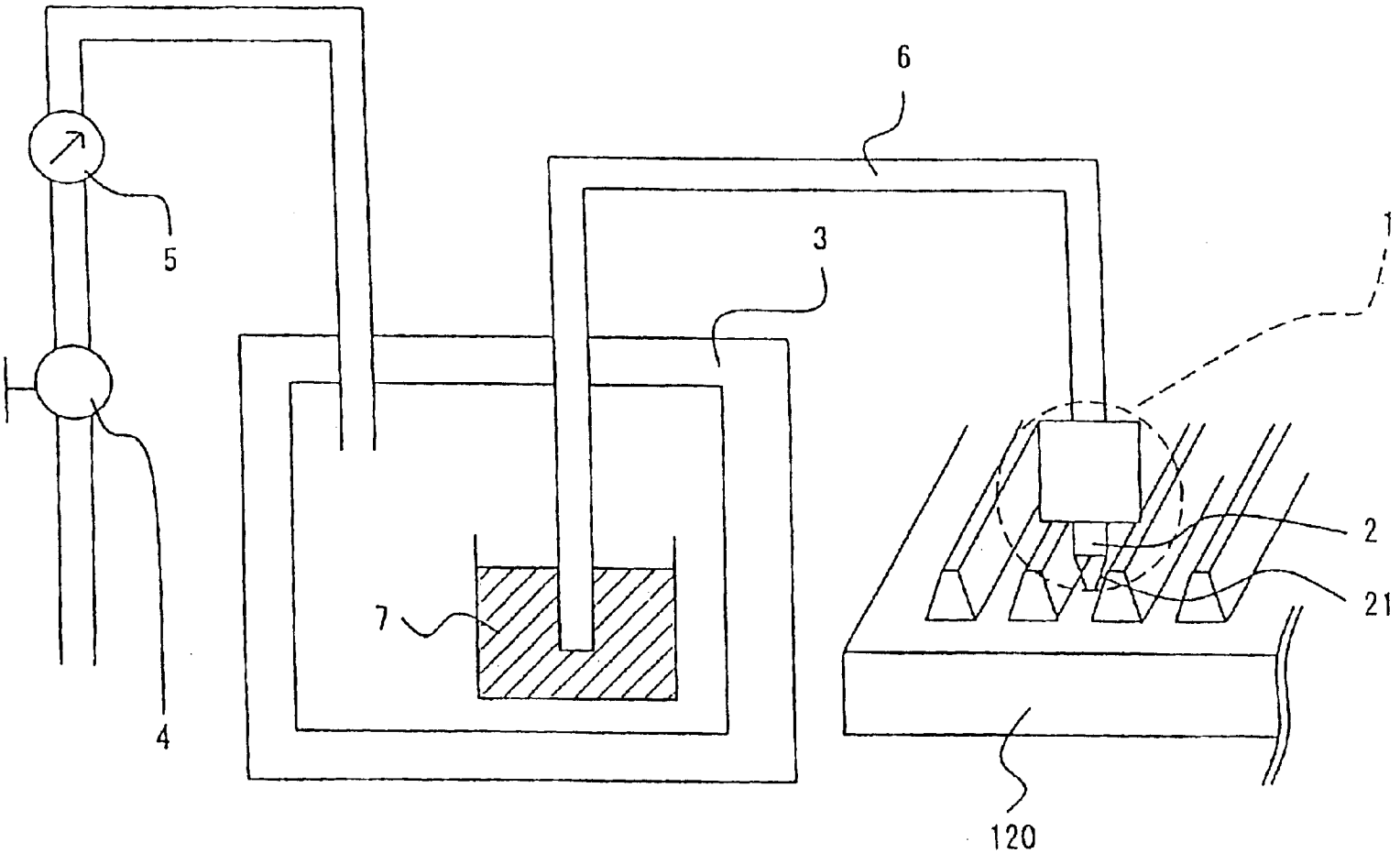
FIG. 1 is a diagram illustrating the entire fluorescent layer forming apparatus according to a first embodiment of the present invention.
Figure 2:
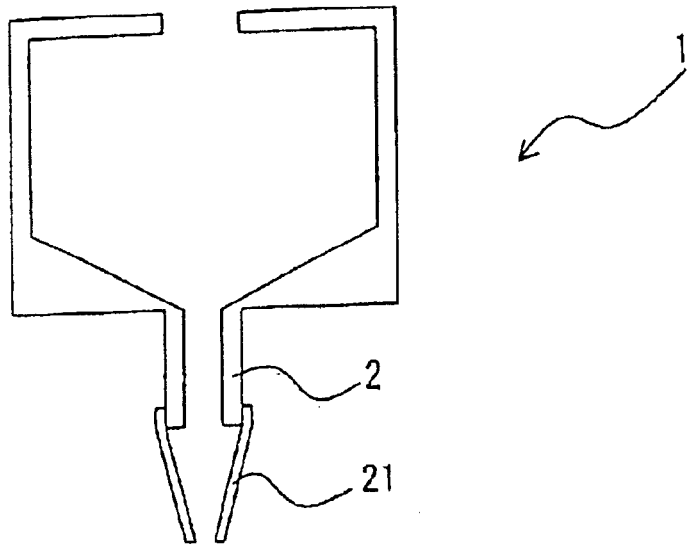
FIGS. 2(A) and 2(B) are detailed diagrams illustrating a dispenser and a nozzle of the fluorescent layer forming apparatus shown in FIG. 1.
Figure 2:
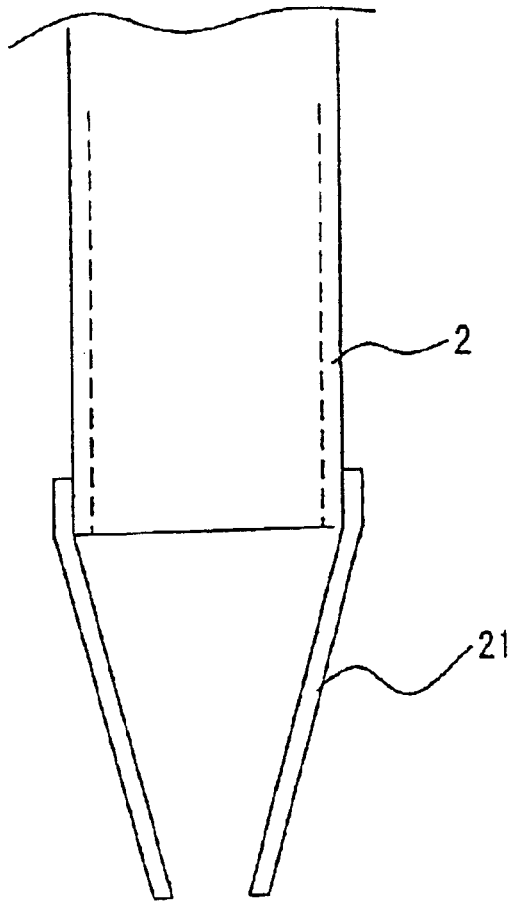
Figure 3:
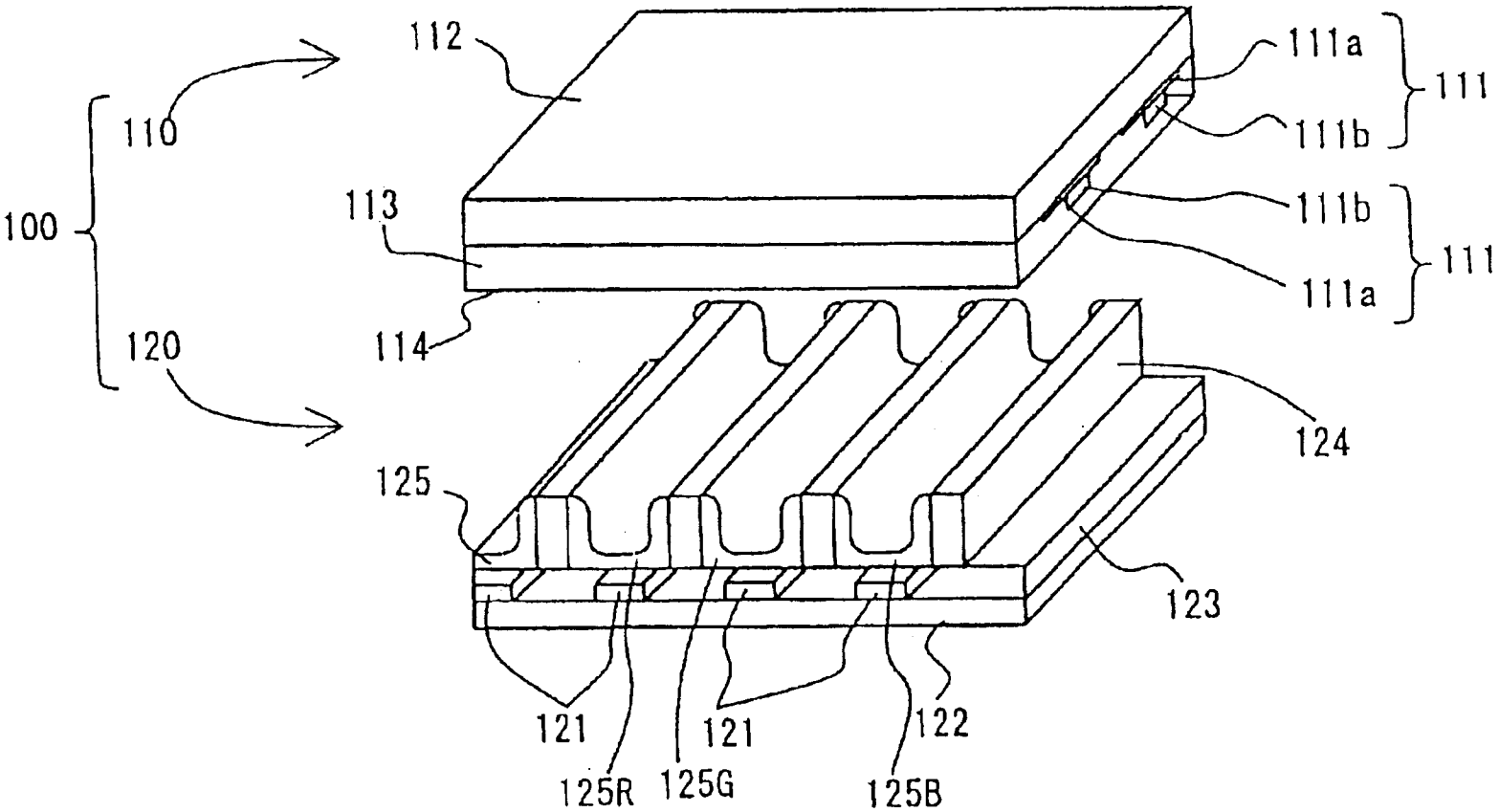
FIG. 3 is a diagram illustrating a PDP having fluorescent layers to be formed by means of the fluorescent layer forming apparatus according to the first embodiment.

A fluorescent layer forming apparatus according to a first embodiment of the present invention will be described with reference to FIGS. 1 to 3. FIG. 1 illustrates the entire fluorescent layer forming apparatus according to this embodiment, and FIGS. 2(A) and 2(B) illustrate, in detail, a dispenser and a nozzle of the fluorescent layer forming apparatus shown in FIG. 1. FIG. 3 illustrates a plasma display panel having fluorescent layers to be formed by means of the fluorescent layer forming apparatus according to this embodiment.

The fluorescent layer forming apparatus according to this embodiment includes a dispenser 1 for ejecting a fluorescent material paste 7 into recesses defined between plural barrier ribs arranged parallel to each other on a surface of a substrate (e.g., a rear substrate) of the plasma display panel (hereinafter referred to simply as "PDP"), and a pressure tank 3 for storing the fluorescent material paste 7 and supplying the fluorescent material paste 7 into the dispenser 1 under pressure. The dispenser 1 and the pressure tank 3 are connected by a pipe 6. However, the construction of the fluorescent layer forming apparatus is not limited to this construction.

As shown in FIG. 2(A), the dispenser 1 includes a nozzle 2 disposed at a distal end thereof and serving as an ejection port for ejecting the fluorescent material paste 7. The nozzle 2 has a cavity extending longitudinally therethrough and having a predetermined inner diameter. As shown in FIG. 2(B), two fine attachments 21 are fixed to the outer periphery of the nozzle 2 with proximal ends thereof opposed to each other and with distal end portions thereof arranged in convergent relation. In FIGS. 2(A) and 2(B), the fine attachments 21 are arranged in convergent relation, but the distal ends thereof are spaced a very small distance from each other.

The pressure tank 3 is adapted to store the fluorescent material paste 7 and supply the fluorescent material paste 7 into the dispenser 1 in accordance with the internal gas pressure thereof. The pressure tank 3 is connected to a gas system (not shown) for supplying gas for pressurization of the pressure tank 3, and a gas pressure regulator 4 is provided between the gas system and the pressure tank 3 for regulating the internal gas pressure of the pressure tank 3. A pressure gage 5 for measuring a gas supply pressure is provided between the gas pressure regulator 4 and the pressure tank 3. The gas supply pressure can be adjusted by the gas pressure regulator 4 with reference to a pressure level measured by the pressure gage 5.

The fluorescent material paste 7 is prepared by dissolving a natural or synthetic cellulose resin in an organic solvent and dispersing fluorescent material particles having an average particle diameter of 3 $\mu$m in the resulting resin solution with or without a dispersant. The fluorescent material paste 7 comprises 20 to 30% of the fluorescent material particles, 5 to 10 wt % of the cellulose resin and 50 to 60% of the organic solvent and, optionally, 0.1 to 1% of the dispersant. The fluorescent material paste 7 thus prepared has a viscosity of 100 to 200 poise.

The PDP 100 having the fluorescent layers to be formed by means of the fluorescent layer forming apparatus according to this embodiment is, for example, a common PDP of triode discharge type as shown in FIG. 3, and includes a front substrate 110 on which a plurality of main electrodes (sustainable discharge electrode) 111 are arranged generally parallel to each other, and a rear substrate 120 on which a plurality of address electrodes 121 arranged parallel to each other perpendicularly to the main electrodes 111. The front substrate 110 and the rear substrate 120 are combined in intimate contact with each other via a seal (not shown). A plurality of linear barrier ribs 124 are provided on the rear substrate 120 of the common triode-discharge-type PDP 100 to define recesses therebetween. The fluorescent layer forming apparatus is adapted to apply the fluorescent material paste 7 into these recesses (in FIG. 3, the fluorescent layers 125 (125R, 125G, 125B) are already formed).

In the rear substrate 120, more specifically, the plurality of address electrodes 121 are arranged perpendicularly to the main electrodes 111 on a planar glass substrate, and covered with a transparent dielectric layer 123. The linear barrier ribs 124 are provided between the address electrodes 121 for isolation of electric discharge. Red, green and blue fluorescent layers 125 (125R, 125G, 125B) to be formed by means of the fluorescent layer forming apparatus are provided on upper surface portions of the dielectric layer 123 and side walls of the barrier ribs 124. Although the fluorescent layers 125 for only one pixel are shown in FIG. 3, a multiplicity of fluorescent layers are provided according to the number of pixels of the PDP. The rear substrate 120 typically has a thickness of about 2 mm to about 3 mm, and the transparent dielectric layer 123 typically has a thickness of several tens $\mu$m. The barrier ribs 124 typically each have a thickness of 100 $\mu$m to 200 $\mu$m.

Next, an explanation will be given to the operation of the fluorescent layer forming apparatus according to this embodiment. After the nozzle 2 of the dispenser 1 is placed at a predetermined point in a recess defined between two adjacent barrier ribs 124 on the rear substrate 120 of the PDP 100, gas is supplied into the pressure tank 3 from the gas system to pressurize the pressure tank 3 to a predetermined gas pressure level by adjusting the gas pressure regulator 4 with reference to the pressure gage. When the gas pressure in the pressure tank 3 exceeds the predetermined gas pressure level, the fluorescent material paste 7 is forced out of the pressure tank 3 thereby to be supplied into the dispenser 1 through the pipe 6.

The fluorescent material paste 7 supplied into the dispenser 1 flows through the cavity of the dispenser 1 into the nozzle 2. The front of the fluorescent material paste 7 passes through the nozzle 2, then convergently moves along the fine attachments 21, and passes through a gap defined between the distal ends of the fine attachments 21 to reach the predetermined point in the recess on the rear substrate 120. The distal end of the nozzle 2 is scanned along the recess from one end to the other, while the fluorescent material paste 7 is continuously supplied into the dispenser 1. Thus, the fluorescent material paste 7 is continuously applied into the recess between the two adjacent barrier ribs 124, whereby a linear fluorescent layer 125 is formed in the recess. Although the explanation has been given to a case where the dispenser 1 including the single nozzle is employed for the formation of the single fluorescent layer, a plurality of fluorescent layers 125 can be formed in substantially the same manner by employing a dispenser of a multi-nozzle structure including a plurality of nozzles.

An ejection rate (the amount of the fluorescent material paste 7 to be ejected per unit time by the nozzle 2) is proportional to the gas pressure in the pressure tank 3 and, therefore, can be adjusted by means of the gas pressure regulator 4. The gas pressure should be adjusted, depending on the viscosity of the paste, the nozzle movement rate and a distance between the distal ends of the fine attachments and the rear substrate 120. For example, the gas pressure (ejection pressure) is set at about 0.3 MPa for properly forming the fluorescent layer 125, where the viscosity of the paste is 20 Pa·s, the nozzle movement rate is 40 mm/s and the distance between the distal ends of the fine attachments and the rear substrate 120 is 200 $\mu$m.

In the fluorescent layer forming apparatus according to this embodiment, as described above, the two fine attachments 21 are fixed to the outer periphery of the distal end portion of the nozzle 2 with the proximal ends thereof opposed to each other and with the distal end portions thereof arranged in convergent relation. When the fluorescent material paste 7 supplied into the dispenser 1 from the pressure tank 3 reaches the nozzle 2, the front of the fluorescent material paste 7 moves along the fine attachments 21 arranged in convergent relation. Therefore, the fluorescent material paste 7 is convergently ejected from the nozzle 2. Thus, the fluorescent layer 125 can accurately be formed in the intended recess between the barrier ribs 124 without formation of a clot and without adhesion of the fluorescent material paste 7 onto the top edges of the barrier ribs 124.

The fine attachments may be composed of a material having a contact angle of not greater than 60 degrees with respect to the fluorescent material paste 7. In this case, the fluorescent material paste can more smoothly move along the fine attachments without formation of clot. The material of the fine attachment may be stainless, for example.

Second Embodiment

A fluorescent layer forming apparatus according to a second embodiment of the present invention will be described with reference to FIGS. 4(A) and 4(B), which illustrate, in detail, a nozzle of the fluorescent layer forming apparatus according to this embodiment.

Figure 4:
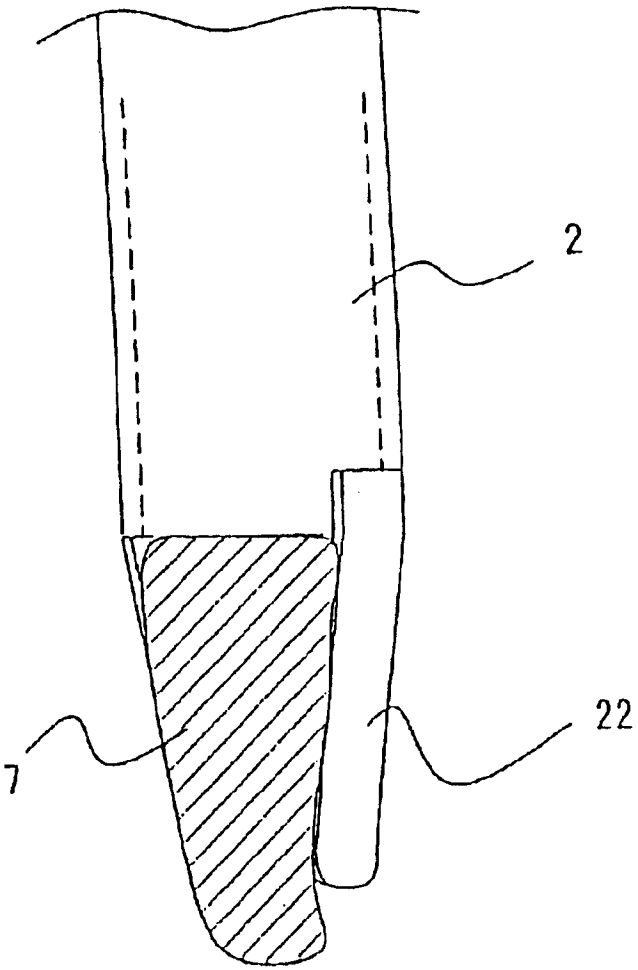
FIGS. 4(A) and 4(B) are detailed diagrams illustrating a nozzle of a fluorescent layer forming apparatus according to a second embodiment of the present invention.
Figure 4:
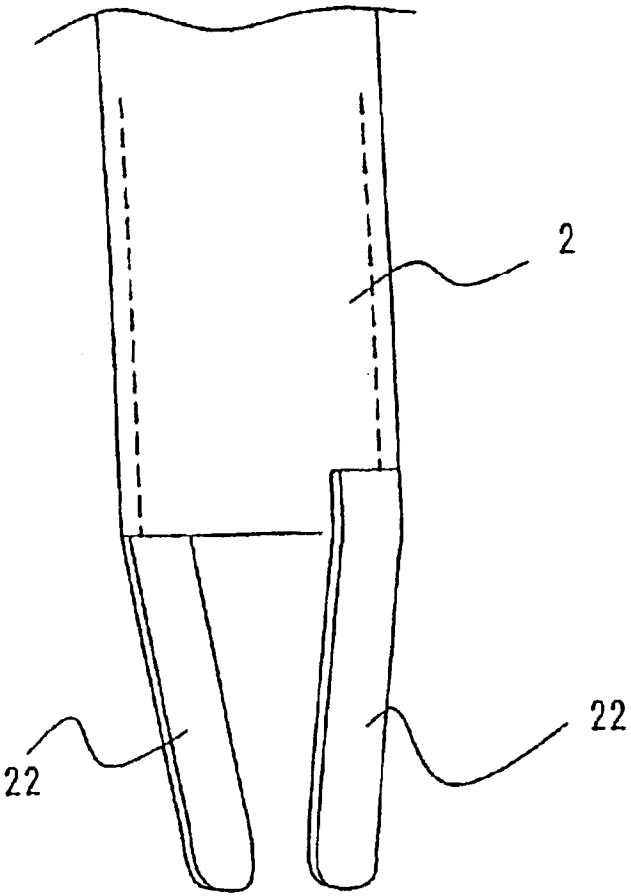

The fluorescent layer forming apparatus according to this embodiment has substantially the same construction as the first embodiment, except that two opposed fine plate attachments 22 are fixed to the outer periphery of a distal end portion of the nozzle 2 with distal end portions thereof arranged in convergent relation as shown in FIG. 4(A). When a fluorescent layer is to be formed, the fine plate attachments 22 are located in a recess defined between two adjacent barrier ribs 124 in opposed relation to the barrier ribs 124.

Opposed inner surfaces of the fine plate attachments 22 each have a higher wettability, and outer surfaces of the fine plate attachments 22 opposite from the opposed inner surfaces each have a lower wettability. With this arrangement, the fluorescent material paste 7 supplied through the nozzle 2 flows in contact with the highly wettable opposed inner surfaces of the fine plate attachments 22, and convergently ejected from a gap defined between the fine plate attachments 22. The distal ends of the fine plate attachments 22 are each rounded in a semicircular shape. Hence, there is no possibility that the fine plate attachments 22 scrape the bottom of the recess on the rear substrate 120 when the nozzle 2 is scanned along the recess with the fine plate attachments 22 kept in contact with the bottom of the recess.

Next, an explanation will be given to the operation of the fluorescent layer forming apparatus according to this embodiment. As in the first embodiment, the fluorescent material paste 7 is forced out of the pressure tank 3 to be supplied into the dispenser 1 through the pipe 6. The fluorescent material paste 7 supplied into the dispenser 1 flows through the cavity of the dispenser 1 into the nozzle 2. The front of the fluorescent material paste 7 passes through the nozzle 2, then convergently moves along the fine plate attachments 22, and passes through the gap defined between the distal ends of the fine plate attachments 22 (see FIG. 4(B)) to reach a predetermined point in the recess on the rear substrate 120.

The distal end of the nozzle 2 is scanned along the recess from one end to the other, while the fluorescent material paste 7 is continuously supplied into the dispenser 1. Thus, the fluorescent material paste 7 is continuously applied into the recess between the two adjacent barrier ribs 124, whereby a linear fluorescent layer 125 is formed in the recess. Even if the ejection rate of the fluorescent material paste 7 is so high that the fluorescent material paste 7 cannot smoothly flow along the fine plate attachments 22, the ejected fluorescent material paste 7 spreads in the recess only longitudinally of the barrier ribs 124 because the fine plate attachments 22 are arranged in opposed relation to the barrier ribs 124. This prevents the fluorescent material paste 7 from spreading across the barrier ribs. Therefore, the fluorescent material paste 7 is applied neither onto the top edges of the barrier ribs 124 nor into unintended adjacent recesses.

In the fluorescent layer forming apparatus according to this embodiment, as described above, the two opposed fine plate attachments 22 are fixed to the outer periphery of the distal end portion of the nozzle 2 of the dispenser 1 with the distal end portions thereof arranged in convergent relation. In the formation of the fluorescent layer, the fine plate attachments 22 are located in the recess in opposed relation to the barrier ribs 124. When the fluorescent material paste 7 supplied into the dispenser 1 from the pressure tank 3 reaches the nozzle 2, the front of the fluorescent material paste 7 moves along the fine attachments 21 arranged in convergent relation. Since the distal ends of the fine plate attachments 22 are kept in contact with the bottom of the recess on the rear substrate 120, the fluorescent material paste 7 is ejected directly into the recess. Therefore, the fluorescent layer 125 can accurately be formed in the intended linear recess defined between the two adjacent barrier ribs 124 without formation of clots and without adhesion of the fluorescent material paste 7 onto the top edges of the barrier ribs 124. Even if the ejection rate of the fluorescent material paste is high, the fluorescent material paste 7 can be ejected into the recess only longitudinally of the barrier ribs 124. Therefore, the fluorescent material paste 7 is applied neither onto the top edges of the barrier ribs 124 nor into unintended adjacent recesses.

Third Embodiment

A fluorescent layer forming apparatus according to a third embodiment of the present invention will be described with reference to FIGS. 5(A) to 5(C). FIG. 5(A) illustrates, in detail, a nozzle of the fluorescent layer forming apparatus according to this embodiment. FIG. 5(B) is a table showing a factor determined by the surface tension and density of a fluorescent material paste. FIG. 5(C) is a graph illustrating a relationship between the outer diameter of the nozzle and the length of fine attachments.

The fluorescent layer forming apparatus according to this embodiment has substantially the same construction as the first embodiment except for the construction of the fine attachments 21 fixed to the nozzle 2. Two pairs of opposed fine attachments are fixed to the nozzle 2 as extending linearly from the nozzle 2 but not in convergent relation as shown in FIG. 5(A), and portions of the fine attachments 21 projecting from the nozzle 2 each have a length not smaller than the radius of the nozzle 2. When these fine attachments 21 are located in a recess defined between two adjacent barrier ribs 124 for formation of a fluorescent layer, one pair of opposed fine attachments 21 are arranged in opposed relation to the barrier ribs 124, and the other pair of opposed fine attachments 21 are arranged longitudinally of the barrier ribs 124.

An explanation will be given to a reason why the length of the portions of the fine attachments 21 projecting from the nozzle 2 is set at not smaller than the radius of the nozzle 2. The fluorescent layer forming apparatus employs a dropwise application method for the application of the fluorescent material paste 7. In the dropwise application method, a liquid droplet calmly drops from an end of a vertical pipe when its weight exceeds its surface tensile force. It is herein assumed that the nozzle has an outer diameter D, and the fluorescent material paste 7 has a density $\rho$, a surface tension $\gamma$, a droplet mass m and a droplet radius R. When the droplet drops, an expression $mg \geqq \pi D\gamma$ is satisfied. Immediately before and after the dropping, an expression $mg=\pi D\gamma$ is satisfied. The mass m is herein represented by $m=4/3(\pi R^3\rho)$, which is substituted into $mg=\pi D\gamma$. Then, $4/3(\pi R^3\rho)g=\pi D\gamma$ is obtained. A drop-starting droplet radius Rs, i.e., the radius of the droplet at the start of the dropping, is represented by $Rs=(3/4)^{1/3}(\gamma/\rho g)^{1/3}(D)^{1/3}$. For suppression of deflection of the fluorescent material paste 7 around the fine attachments 21, the length h of the portions of the fine attachments 21 projecting from the nozzle 2 should be not smaller than the radius of the droplet, i.e., satisfy the following expression:

$$h>Rs=(3/4)^{1/3}(\gamma/\rho g)^{1/3}(D)^{1/3}$$

In this expression, $(3/4)^{1/3}(\gamma/\rho g)^{1/3}$ is regarded as a factor, which is determined by assigning specific values to the variables γ and ρ as shown in FIG. 5(B). Curves (1) to (5) represented by relational expressions obtained by assigning different sets of specific values to the variables y and p are shown in the graph in FIG. 5(C), wherein the outer diameter (mm) of the nozzle and the drop-starting droplet radius (mm) are plotted as abscissa and ordinate, respectively. In view of the range of the outer diameter of an ordinary nozzle (about 0.2 mm to about 0.4 mm) and the possible ranges of the variables γ and ρ, the factor is considered to take a value not smaller than $1.0\times10^{-2}$. More strictly, the length h is desirably $h>Rs=1.0\times10^{-2}(D)^{1/3}$. A line (6) in FIG. 5(C) is represented by an expression $h=(1/2)\times D$. Where the outer diameter D of the nozzle 2 is in the range of about 0.2 mm to about 0.4 mm, the curves (1) to (5) represented by the relational expressions at least partly fall within a range represented by $h\geqq(1/2)\times D$. That is, if the length h of the projecting portions of the fine attachments is not smaller than the radius of the nozzle 2, the fluorescent material paste 7 is prevented from deflecting around the fine attachments 21. Thus, the fluorescent material paste 7 can continuously smoothly be applied dropwise in the recess for a long period of time.

In the fluorescent layer forming apparatus according to this embodiment, the portions of the fine attachments 21 projecting from the nozzle 2 each have a length not smaller than the radius of the nozzle 2. Therefore, the fluorescent material paste 7 can accurately be applied in the recess. Since the fluorescent material paste 7 is prevented from deflecting around the fine attachments 21, the fluorescent material paste 7 can continuously smoothly be applied dropwise in the recess for a long period of time.

Fourth Embodiment

A fluorescent layer forming apparatus according to a fourth embodiment of the present invention will be described with reference to FIGS. 6(A) to 6(C), 7(A) and 7(B), which illustrate, in detail, a nozzle of the fluorescent layer forming apparatus according to this embodiment.

Figure 6:
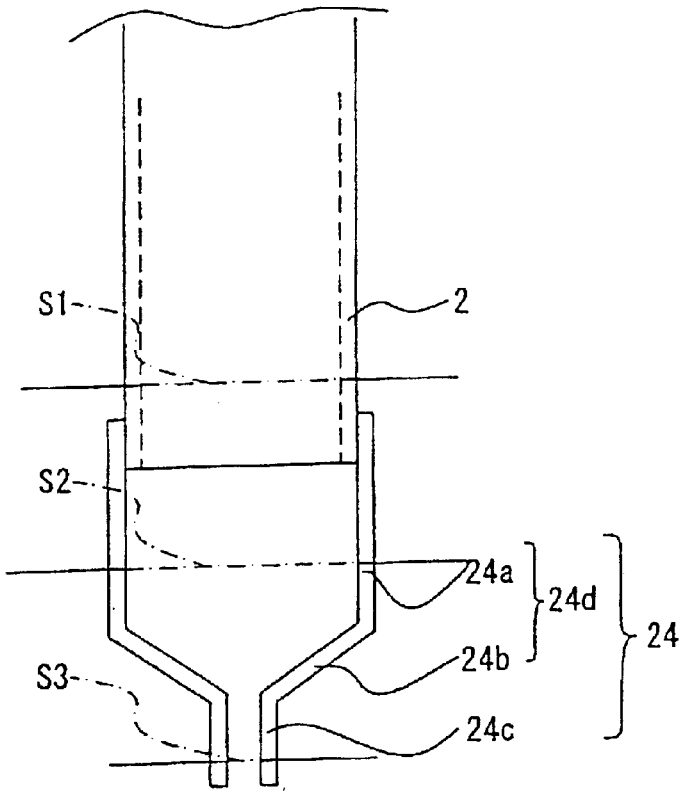
FIGS. 6(A) to 6(C) are detailed diagrams illustrating a nozzle of a fluorescent layer forming apparatus according to a fourth embodiment of the present invention.
Figure 6:
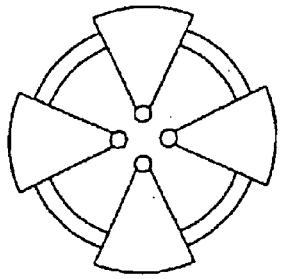
Figure 6:
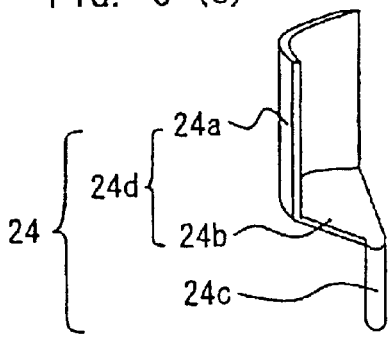

The fluorescent layer forming apparatus according to this embodiment has substantially the same construction as the first embodiment except for the construction of the fine attachments fixed to the nozzle 2. That is, two pairs of opposed fine attachments 24 as shown in FIGS. 6(A) to 6(C) are fixed to the outer periphery of the nozzle 2. The fine attachments 24 each include an extension plate portion 24*a* extending longitudinally of the nozzle 2, a fan-shaped deflection plate portion 24*b* extending continuously from a distal edge of the extension portion 24*a* toward the center line of the nozzle 2, and a rod portion 24*c* extending from a distal end of the deflection portion 24*b* longitudinally of the nozzle 2. When the fine attachments 24 are located in a recess defined between two adjacent barrier ribs 124 for formation of a fluorescent layer, one pair of opposed fine attachments are arranged in opposed relation to the barrier ribs 124 and the other pair of opposed fine attachments are arranged longitudinally of the barrier ribs 124. An internal space defined by the extension portions 24*a* and the deflection portions 24*b* serves as a retaining portion 24*d*, which retains the fluorescent material paste 7 supplied from the nozzle 2 and smoothly and accurately supplies the fluorescent material paste 7 into a space defined by the rod portions 24*c*.

The cross sectional area S1 of a space (an inner portion of the retaining portion 24*d*) defined by the extension portions 24*a*, the cross sectional area S2 of the nozzle 2 and the cross sectional area S3 of the space defined by the rod portions 24*c* satisfy a relational expression $S1\geqq S2>S3$.

Next, an explanation will be given to the operation of the fluorescent layer forming apparatus according to this embodiment. As in the first embodiment, the fluorescent material paste 7 is supplied into the dispenser 1. The fluorescent material paste 7 supplied into the dispenser 1 flows through the cavity of the dispenser 1 into the nozzle 2. The front of the fluorescent material paste 7 moves through the nozzle 2 to reach the extension portions 24*a* of the fine attachments 24. The space defined by the extension portions 24*a* has a cross sectional area S2 greater than the cross sectional area S1 of the nozzle 2 and partly opens laterally, so that the fluorescent material paste 7 can smoothly be introduced into the retaining portion 24*d* from the nozzle 2. The fluorescent material paste 7 introduced into the retaining portion 24*d* flows along the extension portions 24*a*, then along the deflection portions 24*b* and along the rod portions 24*c*. The fluorescent material paste 7 passes through the space defined by the rod portions 24*c* to reach a predetermined point in the recess on the rear substrate 120. Then, the fluorescent layer forming apparatus is operated in the same manner as in the first embodiment.

In the fluorescent layer forming apparatus according to this embodiment, the fine attachments 24 each including the extension portion 24*a*, the deflection portion 24*b* and the rod portion 24*c* are fixed to the nozzle 2. When the fine attachments 24 are located in the recess for the formation of the fluorescent layer, the one pair of opposed fine attachments 24 are arranged in opposed relation to the barrier ribs 124 and the other pair of opposed fine attachments 24 are arranged longitudinally of the barrier ribs 124. Further, the fluorescent material paste 7 ejected from the nozzle 2 is retained in the retaining portion 24*d* defined by the extension portions 24*a* and the deflection portions 24*b*. Therefore, the fluorescent material paste 7 can continuously be supplied into the space defined by the rod portions 24*c* from the retaining portion 24*d* defined by the extension portions 24*a* and the deflection portions 24*b* thereby to be more easily and more accurately applied into the recess without deflection thereof around the fine attachments and without adhesion thereof onto the outer periphery, as compared with a case where the nozzle 2 provided with only one pair of opposed fine attachments is moved along the barrier ribs for application of the fluorescent material paste 7 with the fine attachments being arranged in opposed relation to the barrier ribs (in this case, the fluorescent material paste deflects around the outer periphery of the fine attachments thereby to adhere onto the outer periphery).

Figure 7:
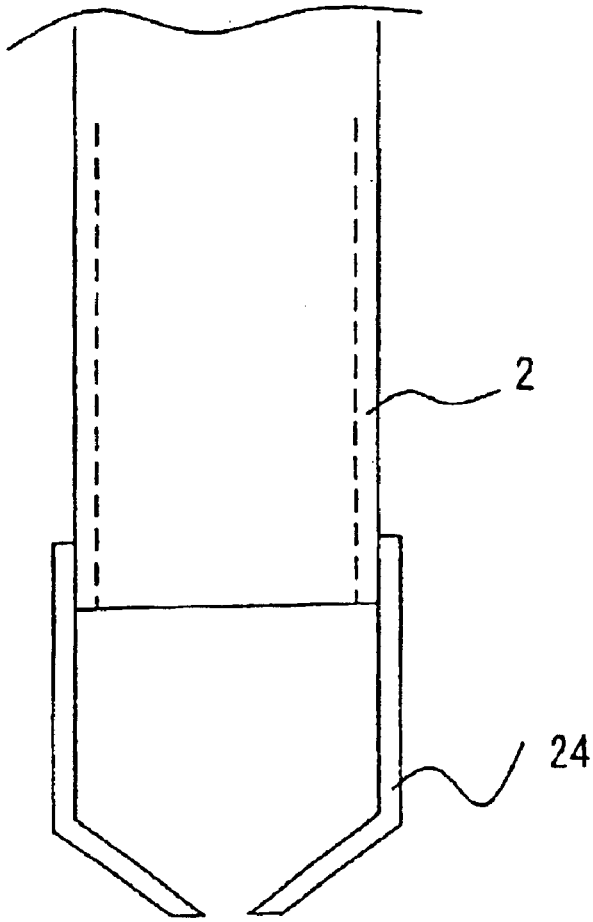
FIGS. 7(A) and 7(B) are detailed diagrams illustrating a nozzle of a fluorescent layer forming apparatus according to a modification of the fourth embodiment.
Figure 7:
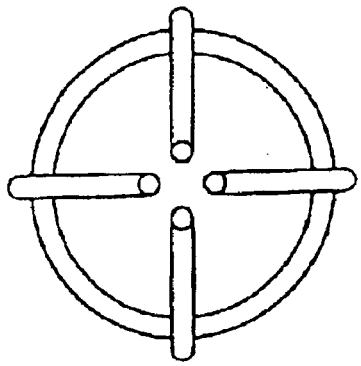

According to a modification of this embodiment, the fine attachments 24 of the fluorescent layer forming apparatus may each entirely have a rod shape as shown in FIGS. 7(A) and 7(B), rather than partly have a plate shape.

Fifth Embodiment

Figure 8:
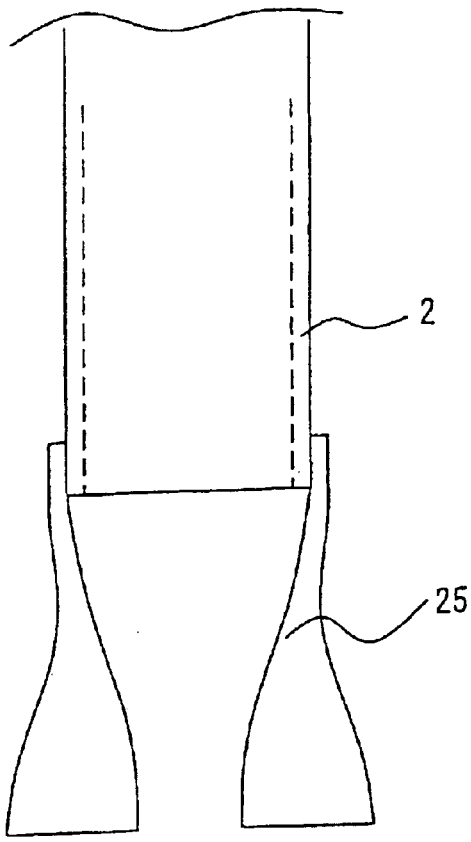
FIGS. 8(A) to 8(C) are detailed diagrams illustrating a nozzle of a fluorescent layer forming apparatus according to a fifth embodiment of the present invention.
Figure 8:
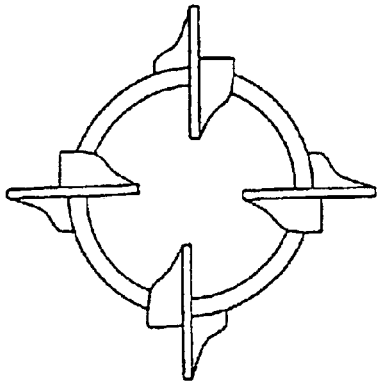
Figure 8:
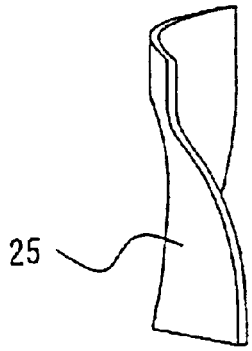

A fluorescent layer forming apparatus according to a fifth embodiment of the present invention will be described with reference to FIGS. 8(A) to 8(C), which illustrate, in detail, a nozzle of the fluorescent layer forming apparatus according to this embodiment.

The fluorescent layer forming apparatus according to this embodiment has substantially the same construction as the first embodiment except for the construction of the fine attachments fixed to the nozzle 2. As shown in FIGS. 8(A) to 8(C), two pairs of opposed fine attachments 25 each having a curved plate shape are fixed to the nozzle 2. The fine attachments 25 are each twisted so that distal end portions thereof are angularly offset by 90 degrees from proximal end portions thereof.

Next, an explanation will be given to the operation of the fluorescent layer forming apparatus according to this embodiment. As in the first embodiment, the fluorescent material paste 7 is supplied into the dispenser 1, and then flows through the cavity of the dispenser 1 into the nozzle 2. The front of the fluorescent paste 7 passes through the nozzle 2, then moves along the curved surfaces of the fine attachments 25, and passes through a gap defined by the distal ends of the fine attachments 25 to reach a predetermined point in a recess defined between two adjacent barrier ribs 124 on the rear substrate 120. Then, the fluorescent layer forming apparatus is operated in the same manner as in the first embodiment.

In the fluorescent layer forming apparatus according to this embodiment, the fine attachments 25 each having a plate shape are fixed to the nozzle 2, and twisted so that the distal end portions thereof are angularly offset by 90 degrees from the proximal end portions thereof. Further, when the fine attachments 25 are located in the recess for the formation of the fluorescent layer, one pair of opposed fine attachments 25 are arranged in opposed relation to the barrier ribs and the other pair of opposed fine attachments 25 are arranged longitudinally of the barrier ribs. Since the nozzle 2 is surrounded by the four fine attachments 25, the fluorescent material paste 7 ejected from the nozzle 2 can be applied into the recess without adhesion thereof onto the outer periphery of the fine attachments 25. Even if the ejection rate of the fluorescent material paste is increased, the fine attachments 25 each twisted by 90 degrees give no resistance to the fluorescent material paste 7, so that the fluorescent material paste 7 can smoothly be applied into the recess.

Modifications of Foregoing Embodiments

Figure 9:
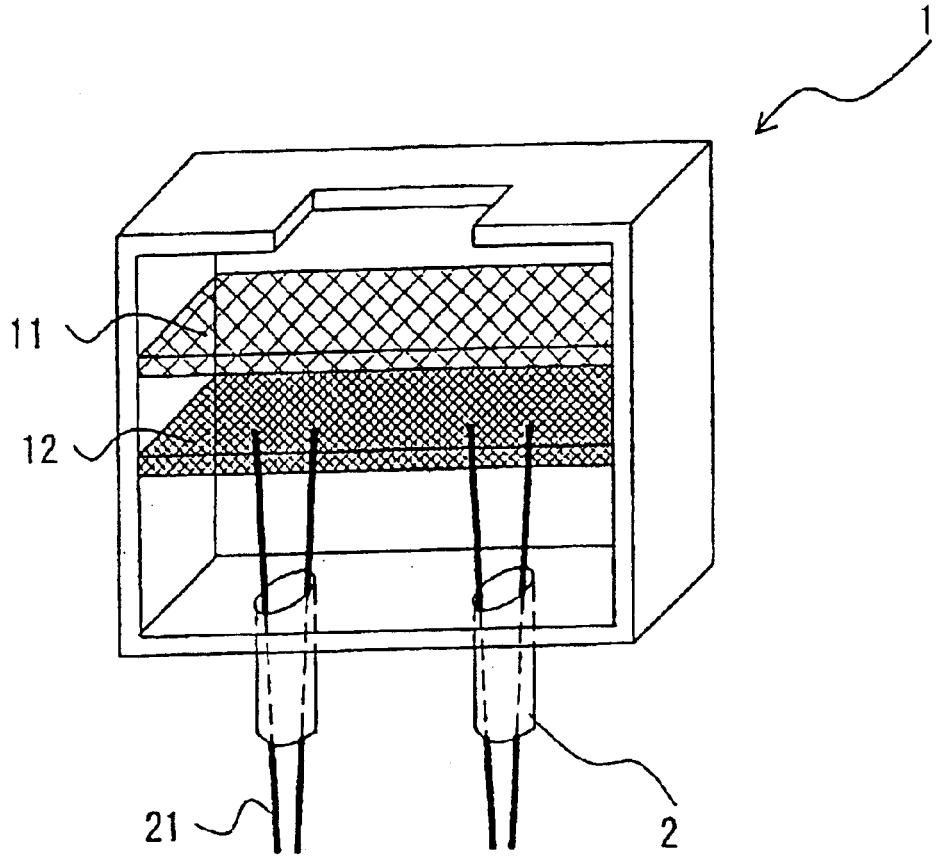
FIG. 9 is a detailed diagram illustrating a nozzle of a fluorescent layer forming apparatus according to a modification of the first or second embodiment.
Figure 10:
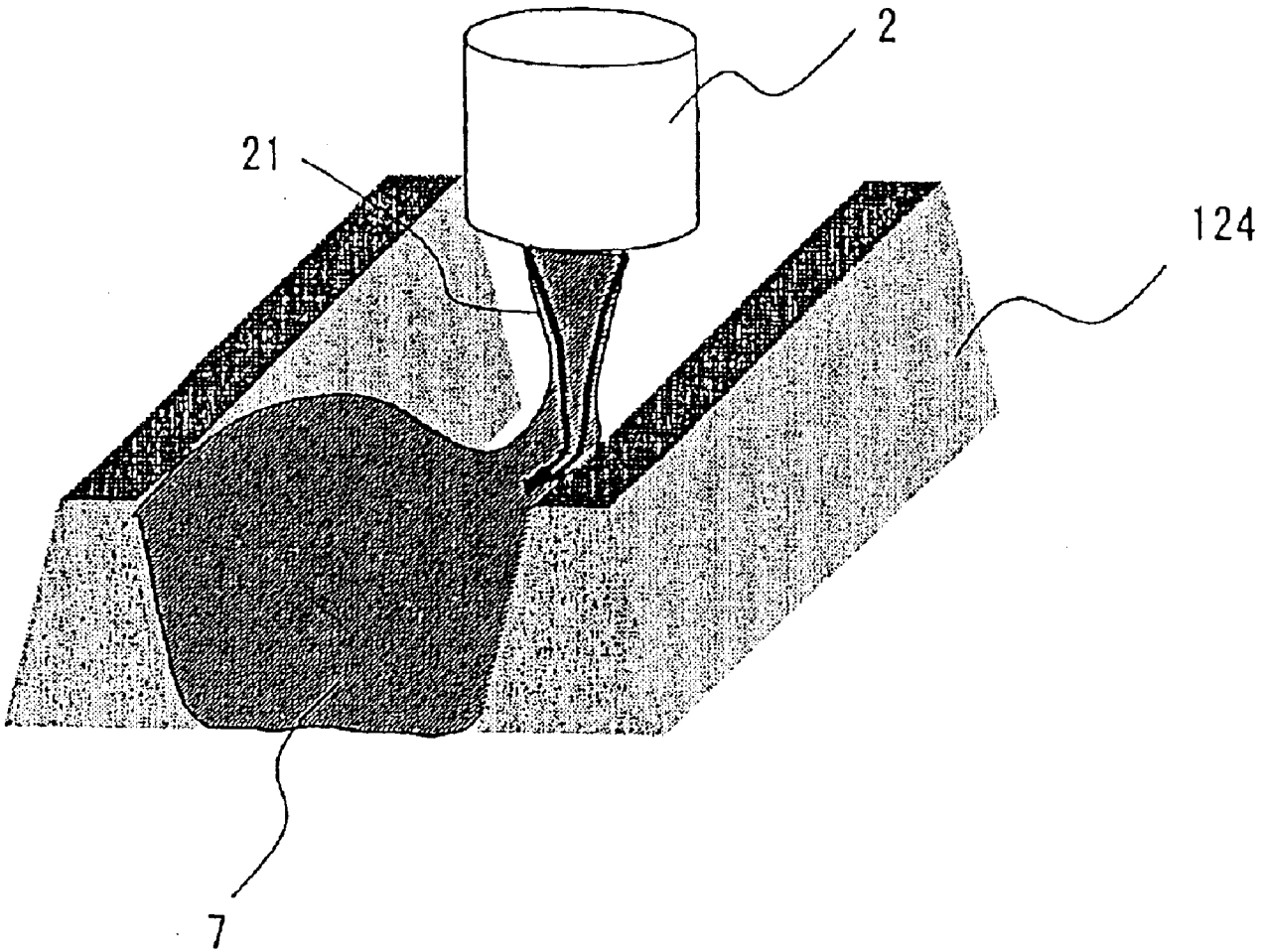
FIG. 10 is a diagram for explaining the operation of the fluorescent layer forming apparatus according to the modification of the first or second embodiment.

According to a modification of the first or second embodiment, as shown in FIG. 9, a first filter 11 having a first predetermined mesh size for filtering out particles greater in size than the first mesh size is provided above a fluorescent material paste supply port of the nozzle 2 in the cavity of the dispenser 1, and a second filter 12 having a second predetermined mesh size smaller than the first mesh size is provided between the first filter 11 and the supply port of the nozzle 2 in the dispenser 1. The proximal ends of the fine attachments 21 (or 22) are fixed to the second filter 12. With this arrangement, the fluorescent material paste 7 is not directly supplied into the nozzle 2 from the pressure tank 3, but filtered by the first filter 11 for removal of particles greater in size than the first mesh size and by the second filter 12 for removal of particles greater in size than the second mesh size before being supplied into the nozzle 2. Thus, stable formation of the fluorescent material layer 125 can be ensured for a long period of time without the need for frequently replacing the filters 11 and 12. As shown in FIG. 10, the fluorescent material paste 7 is supplied along the fine attachments 21 from the nozzle 2 of the dispenser 1 and ejected into the recess defined between the barrier ribs 124. In FIG. 9, the dispenser 1 is illustrated as having a multi-nozzle structure including a plurality of nozzles. The first and second mesh sizes of the first and second filters 11, 12 provided above the fluorescent material paste supply port of the nozzle 2 should be determined so as to filter out particles greater in size than the size of the fluorescent material particles in the fluorescent material paste 7. Thus, the fluorescent material paste 7 containing all the essential constituents including the fluorescent particles can be ejected along the fine attachments 21 (or 22) into the recess between the barrier ribs 124 for the formation of the fluorescent layer 125.

Further, the fluorescent material paste 7 continuously supplied into the nozzle 2 flows along the fine attachments 21 (or 22) arranged in convergent relation within the nozzle 2 thereby to be continuously ejected convergently from the nozzle 2. Thus, the fluorescent layer 125 can continuously be formed in the intended recess between the barrier ribs.

Figure 11:
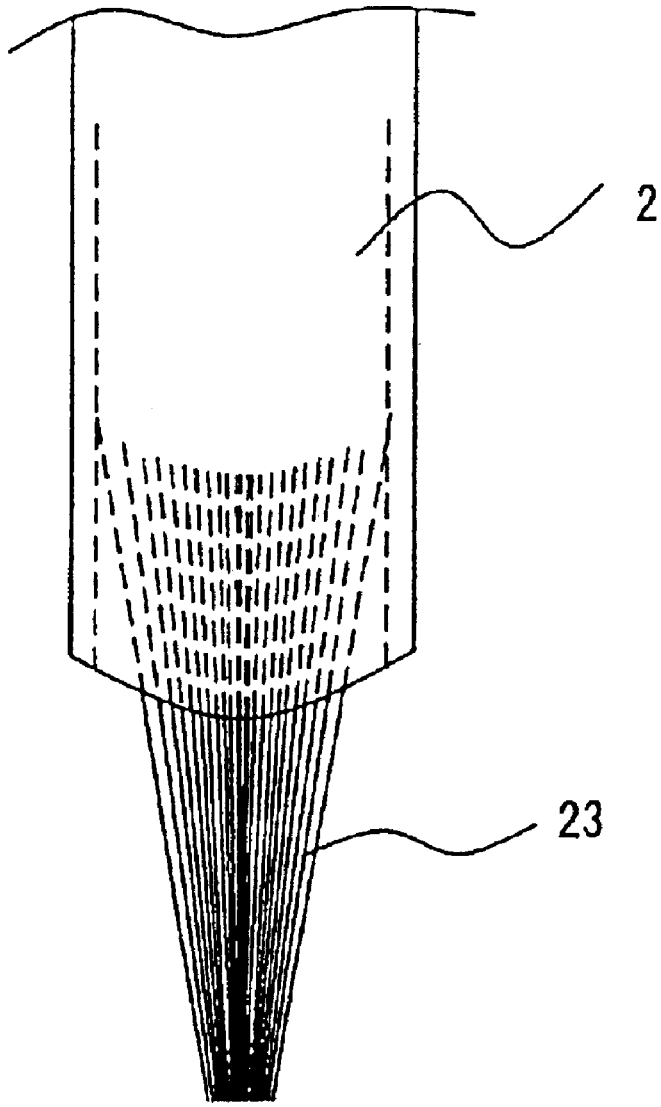
FIG. 11 is a detailed diagram illustrating a nozzle of a fluorescent layer forming apparatus according to another modification of the first or second embodiment.

According to another modification of the first or second embodiment, a multiplicity of fine attachments of filaments or fine strips are fixed to the nozzle 2 in convergent relation as shown in FIG. 11. When the fluorescent material paste 7 is supplied into the nozzle 2, the front of the fluorescent material paste 7 moves along the multiplicity of fine attachments 23 arranged in convergent relation within the nozzle 2. Therefore, the fluorescent material paste 7 can assuredly convergently be ejected from the nozzle 2 into the intended recess without formation of clots. Thus, the fluorescent layer 125 can accurately be formed in the intended recess between the barrier ribs 124 without adhesion of the fluorescent material paste 7 onto the top edges of the barrier ribs 124.

In this modification, portions of the fine attachments projecting from the distal end of the nozzle 2 may have a length of not smaller than 500 $\mu$m.

Figure 12:
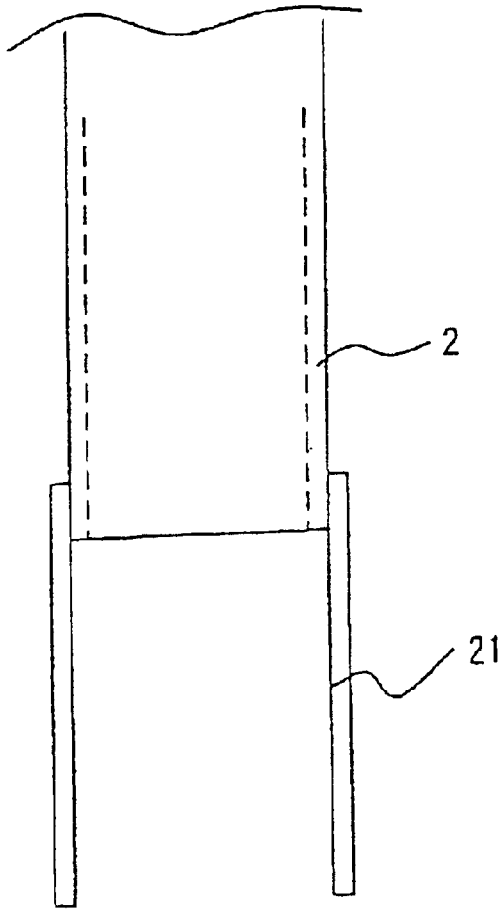
FIGS. 12(A), 12(B) and 12(C) are detailed diagrams illustrating a nozzle of a fluorescent layer forming apparatus according to further another modification of the first or second embodiment.
Figure 12:
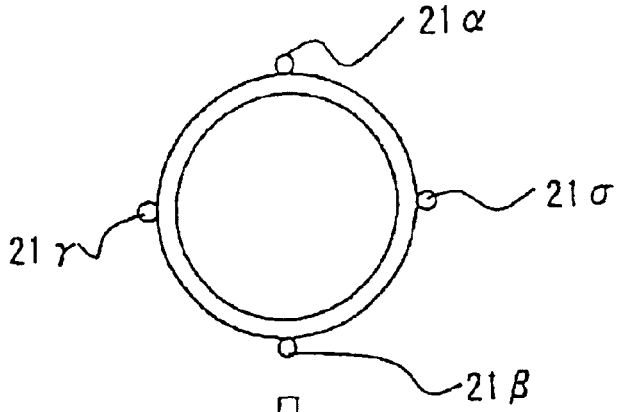
Figure 12:
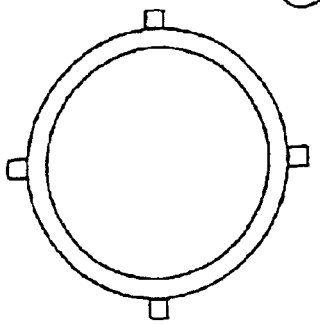
Figure 13:
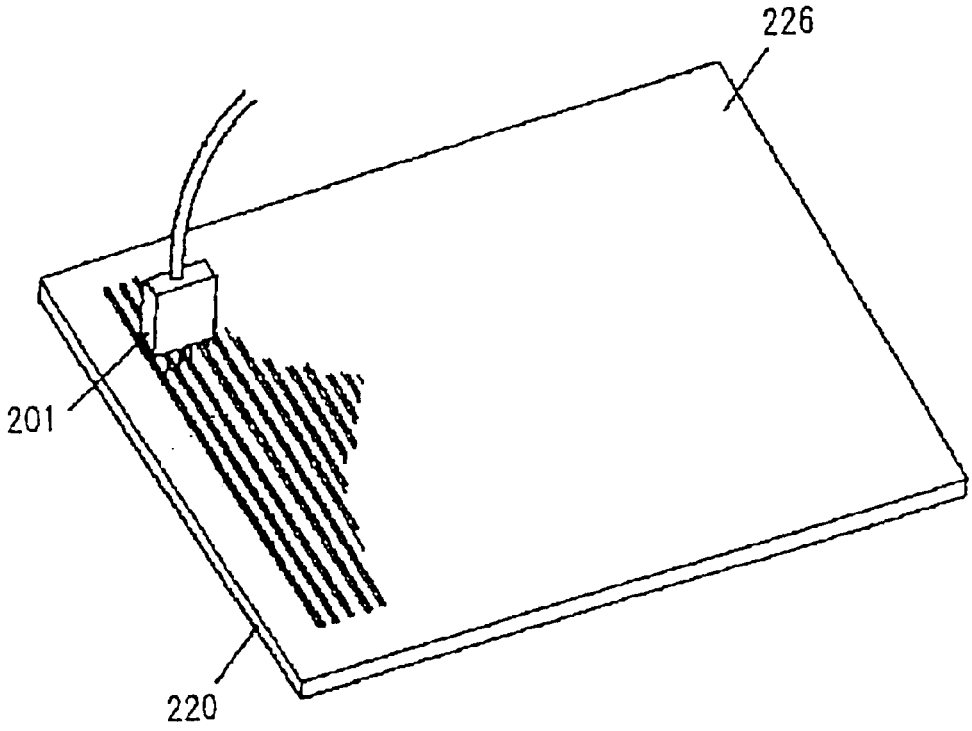
FIG. 13 PRIOR ART
FIG. 13 is a diagram for explaining the operation of a conventional fluorescent layer forming apparatus.
Figure 14:
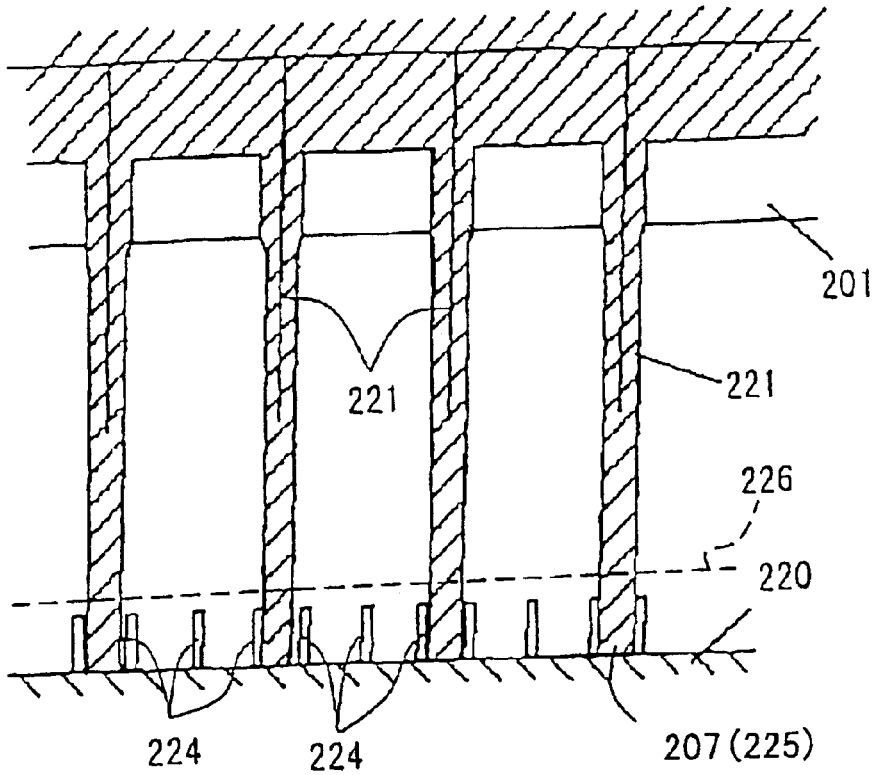
FIG. 14 (A) PRIOR ART
FIGS. 14(A) and 14(B) are a detailed diagram illustrating a nozzle of the conventional fluorescent layer forming apparatus.
Figure 14:
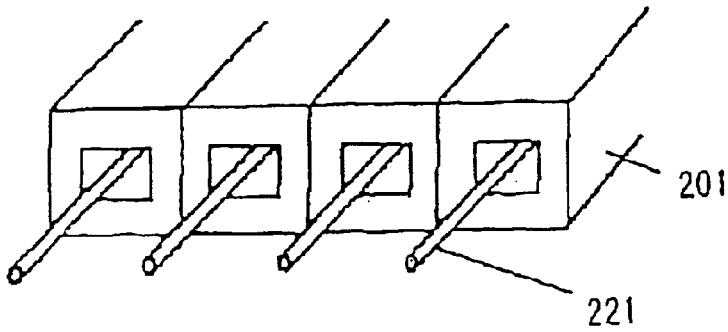
FIG. 14 (B) PRIOR ART

According to further another modification of the first or second embodiment, as shown in FIGS. 12(A) and 12(B), two pairs of opposed linear fine attachments 21 (21$\alpha$, 21$\beta$, 21$\gamma$, 21$\delta$) are fixed to the nozzle 2 as extending in non-convergent manner from the nozzle 2. One pair of opposed fine attachments 21$\alpha$, 21$\beta$ to be located longitudinally of the barrier ribs are composed of a material having a higher wettability, while the other pair of opposed fine attachments 21$\gamma$, 21$\delta$ to be located in opposed relation to the barrier ribs are composed of a material having a lower wettability. The fluorescent material paste 7 is biased toward the center line between the barrier ribs by the highly wettable fine attachments 21$\alpha$, 21$\beta$ arranged along a nozzle movement direction longitudinally of the barrier ribs. Further, the approach of the fluorescent material paste 7 to the barrier ribs is restricted by the less wettable fine attachments 21$\gamma$, 21$\delta$ arranged in opposed relation to the barrier ribs. Thus, the fluorescent material paste 7 can accurately be applied into the recess. The fine attachments may each have a square cross section as shown in FIG. 12(C). Alternatively, the fine attachments 21 may each have a cross section having acute-angled corners, or may each have an undulated peripheral surface. Even in this case, the fluorescent material paste 7 can accurately be introduced into the recess.

The modifications described above may be applied to the other embodiments.

In the present invention, as described above, the proximal ends of the plural fine attachments are fixed to the nozzle, and the distal end portions of the fine attachments are arranged in convergent relation. When the fluorescent material paste is supplied into the nozzle, the front of the fluorescent material paste moves along the fine attachments, so that the fluorescent material paste is retained between the fine attachments and convergently ejected from the nozzle without formation of a clot. Thus, the fluorescent layer can accurately be formed in the intended recess between the barrier ribs without adhesion of the fluorescent material paste onto the top edges of the barrier ribs.

In the present invention, the distal end of the nozzle is scanned along the recess for the application of the fluorescent material paste, while the distal ends of the fine attachments fixed to the nozzle are kept in contact with the bottom of the recess. Therefore, the fluorescent material paste is guided along the fine attachments thereby to be applied into the recess between the barrier ribs. Thus, the fluorescent layer can more accurately be formed in the intended recess between the barrier ribs.

In the present invention, the fine attachments are each composed of a material having a contact angle of not greater than 60 degrees with respect to the fluorescent material paste. Therefore, the fluorescent material paste supplied into the nozzle smoothly moves along the fine attachments without stagnation, and is ejected at a predetermined ejection rate from the nozzle without formation of a clot. The fluorescent layer thus formed has a uniform thickness.

In the present invention, the fluorescent material paste has a viscosity of 5 Pa·s to 50 Pa·s at a sheer rate of 4 $s^{-1}$. Therefore, the fluorescent material paste supplied into the nozzle smoothly moves along the fine attachments without stagnation, and is ejected at a predetermined ejection rate from the nozzle without formation of a clot. The fluorescent layer thus formed has a uniform thickness.

In the present invention, the portions of the fine attachments projecting from the nozzle each have a length not smaller than the radius of the nozzle. Therefore, the fluorescent material paste can smoothly and accurately be applied dropwise into the recess without deflection thereof around the outer periphery of the fine attachments. Therefore, the fluorescent material paste can smoothly be applied dropwise into the recess continuously for a long period of time.

In the present invention, the fine attachments fixed to the nozzle define the retention portion having a greater cross sectional area than the outlet of the nozzle, and the ejection port having a smaller cross sectional area than the retention portion. Therefore, the fluorescent material paste can accurately be applied into the recess. Since the fluorescent material paste is once retained in the retention portion and then ejected, the fluorescent material paste can smoothly be supplied even if the ejection rate of the fluorescent material paste is changed.

In the present invention, the filter having a predetermined mesh size is provided above the fluorescent material paste supply port of the nozzle for filtering out particles greater in size than the predetermined mesh size. Therefore, particles greater in size than the predetermined mesh size can be filtered out for prevention of clogging of the nozzle, before the fluorescent material paste is supplied into the nozzle. Thus, stable formation of the fluorescent layer can be ensured for a long period of time.

What is claimed is:

1. A fluorescent layer forming apparatus for applying a fluorescent material paste into a recess defined between barrier ribs formed on a substrate for formation of a fluorescent layer in a plasma display panel production process, the apparatus comprising:

a nozzle for ejecting the fluorescent material paste; and a plurality of fine attachments provided at one end of the nozzle with distal end portions thereof being arranged in convergent relation, whereby the fluorescent material paste is ejected along the plurality of fine attachments so as to be applied onto a predetermined position in the recess for the formation of the fluorescent layer.

2. A fluorescent layer forming apparatus as set forth in claim 1, which is adapted to eject the fluorescent material paste with distal ends of the fine attachments kept in contact with a bottom of the recess defined between the barrier ribs.

3. A fluorescent layer forming apparatus as set forth in claim 1, wherein the fine attachments are each composed of a material having a wetting contact angle of not greater than 60 degrees with respect to the fluorescent material paste.

4. A fluorescent layer forming apparatus as set forth in claim 1 or 2, wherein the fluorescent material paste has a viscosity of 5 Pa·s to 50 Pa·s at a sheer rate of 4 $s^{-1}$.

5. A fluorescent layer forming apparatus as set forth in claim 3, wherein the fluorescent material paste has a viscosity of 5 Pa·s to 50 Pa·s at a sheer rate of 4 $s^{-1}$.

6. A fluorescent layer forming apparatus for applying a fluorescent material paste into a recess defined between barrier ribs formed on a substrate for formation of a fluorescent layer in a plasma display panel production process, the apparatus comprising:

a nozzle for ejecting the fluorescent material paste; and a plurality of fine attachments provided at one end of the nozzle as linearly projecting from the nozzle;

wherein portions of the fine attachments projecting from the nozzle each have a length not smaller than the radius of the nozzle.

7. A fluorescent layer forming apparatus for applying a fluorescent material paste into a recess defined between barrier ribs formed on a substrate for formation of a fluorescent layer in a plasma display panel production process, the apparatus comprising:

a nozzle having an outlet for ejecting the fluorescent material paste; and a plurality of fine attachments provided at one end of the nozzle;

the fine attachments defining a retention portion having a greater cross sectional area than the outlet of the nozzle, and an ejection port having a smaller cross sectional area than the retention portion.

8. A fluorescent layer forming apparatus as set forth in claim 1 or 2, further comprising:

a filter provided above a fluorescent material paste supply port of the nozzle;

wherein proximal ends of the fine attachments are fixed to the filter.

9. A fluorescent layer forming apparatus as set forth in claim 7, further comprising:

a filter provided above a fluorescent material paste supply port of the nozzle;

wherein proximal ends of the fine attachments are fixed to the filter.

10. A fluorescent layer forming apparatus as set forth in claim 6, further comprising:

a filter provided above a fluorescent material paste supply port of the nozzle;

wherein proximal ends of the fine attachments are fixed to the filter.

* * * * *